US008943962B2

(12) United States Patent
Sugihara

(10) Patent No.: US 8,943,962 B2
(45) Date of Patent: Feb. 3, 2015

(54) PRINTING DEVICE, PRINTING METHOD AND COMPUTER-READABLE STORAGE MEDIUM STORING PROGRAM FOR EXECUTING THE PRINTING METHOD

(75) Inventor: Kazuyoshi Sugihara, Tokyo (JP)

(73) Assignee: Tokyo Electron Limited, Tokyo (JP)

( * ) Notice: Subject to any disclaimer, the term of this patent is extended or adjusted under 35 U.S.C. 154(b) by 183 days.

(21) Appl. No.: 13/557,288

(22) Filed: Jul. 25, 2012

(65) Prior Publication Data

US 2013/0025482 A1 Jan. 31, 2013

(30) Foreign Application Priority Data

Jul. 26, 2011 (JP) ..... 2011-163200

(51) Int. Cl.

| | |
|---|---|
| ***B41F 17/14*** | (2006.01) |
| ***B41F 9/00*** | (2006.01) |
| ***B41M 1/10*** | (2006.01) |
| ***B41F 7/02*** | (2006.01) |

(52) U.S. Cl.

CPC ..... *B41F 7/02* (2013.01)
USPC ..... 101/158; 101/163; 101/170

(58) Field of Classification Search

CPC ..... B41F 9/00; B41F 9/01; B41F 17/14; B41P 2200/30; B41M 1/10; B41M 1/26; B41N 10/00; B41N 10/005
USPC ..... 101/153, 158, 163, 170
IPC ..... B41F 17/14
See application file for complete search history.

(56) References Cited

U.S. PATENT DOCUMENTS 5,367,953 A * 11/1994 Yamashita et al. ..... 101/158
6,347,583 B1 * 2/2002 Isogai et al. ..... 101/126

FOREIGN PATENT DOCUMENTS

| | | |
|---|---|---|
| JP | 4-279349 A | 10/1992 |
| JP | 6-945 A | 1/1994 |
| JP | 7-81038 A | 3/1995 |
| JP | 11-245369 A | 9/1999 |
| JP | 3689536 B2 | 6/2005 |

* cited by examiner

*Primary Examiner* — Leslie J Evanisko
(74) *Attorney, Agent, or Firm* — Rothwell, Figg, Ernst & Manbeck, P.C.

(57) ABSTRACT

A printing device includes: a transfer roller and a supporting unit for supporting a target substrate to be printed in which a printing pattern formed on the transfer roller is printed onto the target substrate by rotating the transfer roller on the target substrate. The printing device further includes: an adjusting mechanism which is configured to extend/contract the printing pattern formed on the transfer roller along a rotational direction of the transfer roller by adjusting a pressing amount of the target substrate against the transfer roller based on position information on a pattern printed on the target substrate when the transfer roller is rotated on the target substrate.

16 Claims, 13 Drawing Sheets

PRINTING DEVICE, PRINTING METHOD AND COMPUTER-READABLE STORAGE MEDIUM STORING PROGRAM FOR EXECUTING THE PRINTING METHOD

CROSS-REFERENCE

This document claims priority to Japanese Application Number 2011-163200, filed Jul. 26, 2011, the entire content of which is hereby incorporated by reference.

FIELD OF THE INVENTION

The present invention relates to a printing device, a printing method and a computer-readable storage medium storing therein a program for executing the printing method.

BACKGROUND OF THE INVENTION

There has been proposed a printing method as a method for forming a pattern of a device, such as a liquid crystal display or the like, on a glass substrate, a film substrate and the like. Since the pattern of the device has been required to have a high dimensional accuracy responding to, e.g., miniaturization of pixels in the liquid crystal display, a reverse off-set printing method has been devised as a printing method capable of printing a pattern having a high dimensional accuracy (see, e.g., Japanese Patent Application Publication No. H04-279349).

The reverse off-set printing method includes a printing method using a roller transfer cylinder. The printing method using the roller transfer cylinder has: a coating step for forming a coating surface by coating ink on a surface of the roller transfer cylinder a surface of which is formed of, e.g., a silicone resin; a removing step in which the roller transfer cylinder subjected to the coating step is rotated on a master plate, which is a protrusion plate having protrusion portion in a specific shape, and thus, the ink in the coating surface corresponding to the protrusion portion of the master plate is transferred to be removed; and a transferring step for transferring the ink remained in the coating surface to a work plate as a target substrate to be printed. (see, e.g., Japanese Patent No. 3689536)

In the reverse off-set printing method using the roller transfer cylinder, a pattern of the master plate is transferred to the roller transfer cylinder by relatively moving the roller transfer cylinder with respect to the master plate formed with a glass substrate, a film substrate or the like, while rotating the roller transfer cylinder on the master plate. Then, the pattern transferred to the roller transfer cylinder is transferred to the work plate by relatively moving the roller transfer cylinder with respect to the work plate formed with a glass substrate, a film substrate or the like, while rotating the roller transfer cylinder on the work plate. Therefore, it is easy to obtain the pattern having a dimensional accuracy equivalent to that of a pattern formed by a photolithography technique.

However, the reverse off-set printing method has a drawback described as below.

Compared with conventional printing methods, the reverse off-set printing method using the roller transfer cylinder easily obtains a dimensional accuracy equivalent to that in the photolithography. However, there is a problem in that the dimensional accuracy of the pattern printed on the work plate by transferring the pattern formed on the roller transfer cylinder is inferior to the dimensional accuracy of the pattern formed on the master plate which is used in removing an unnecessary portion of the ink coated on the roller transfer cylinder by transferring.

When the roller transfer cylinder is rotated on the master plate or the work plate, there may be a change in a contact status between the roller transfer cylinder and the master plate or the work plate due to a dimension tolerance, wobbling or the like of each part of a printing device. As a result, the dimensional accuracy of the pattern printed on the work plate is deteriorated, and thus, the printed pattern may deviate from a design dimension.

The problem may be also encountered in a case where a printing pattern formed on a transfer roller including a roller transfer cylinder is printed on a target substrate to be printed as well as the case of the reverse off-set printing method using the roller transfer cylinder, the master plate and the work plate.

SUMMARY OF THE INVENTION

In view of the above, the present invention provides a printing device and a printing method capable of preventing a printing pattern from being deviated from a design dimension of a device due to a change in a contact status between a transfer roller and a target substrate to be printed to thereby print the pattern with a high dimensional accuracy, when the pattern is printed on the target substrate by rotating the transfer roller on the target substrate.

In order to provide solutions for the problem, the present invention devises means described below.

In accordance with an aspect of the present invention, there is provided a printing device including a transfer roller and a supporting unit for supporting a target substrate to be printed, which prints a printing pattern formed on the transfer roller onto the target substrate by rotating the transfer roller on the target substrate. The printing device further includes: an adjusting mechanism which is configured to extend/contract, when the transfer roller is rotated on the target substrate, the printing pattern formed on the transfer roller along a rotational direction of the transfer roller by adjusting a pressing amount of the target substrate against the transfer roller based on position information on another printing pattern which has been already printed on the target substrate.

In accordance with another aspect of the present invention, there is provided a printing method for printing a printing pattern formed on a roller transfer onto a target substrate to be printed, which is supported by a supporting unit, by rotating the transfer roller on the target substrate. The method includes: an adjustment step of adjusting a pressing amount of the target substrate against the transfer roller based on position information on another printing pattern which has been already printed on the target substrate so that the printing pattern formed on the roller transfer is extended/contracted along a rotational direction of the transfer roller when the transfer roller is rotated on the target substrate.

In accordance with the aspects of the present invention, when a pattern is printed on a target substrate to be printed by rotating a transfer roller on the target substrate, the printing pattern is prevented from being deviated from a design dimension of a device due to a change in a contact status between the transfer roller and the target substrate, and thus, the pattern is printed with a high dimensional accuracy.

BRIEF DESCRIPTION OF THE DRAWINGS

The objects and features of the present invention will become apparent from the following description of embodiments, given in conjunction with the accompanying drawings, in which.

DETAILED DESCRIPTION OF THE EMBODIMENTS

Hereinafter, embodiments of the present invention will be described with reference to the accompanying drawings which form a part hereof.

[First Embodiment]

First, a printing device in accordance with a first embodiment of the present invention is described. The printing device in accordance with the present embodiment prints a printing pattern formed on a roller transfer cylinder on a work plate as a target substrate to be printed by rotating the roller transfer cylinder on the work plate which is supported by a supporting unit. Further, the roller transfer cylinder corresponds with a transfer roller in the embodiments of the present invention.

Figure 1:
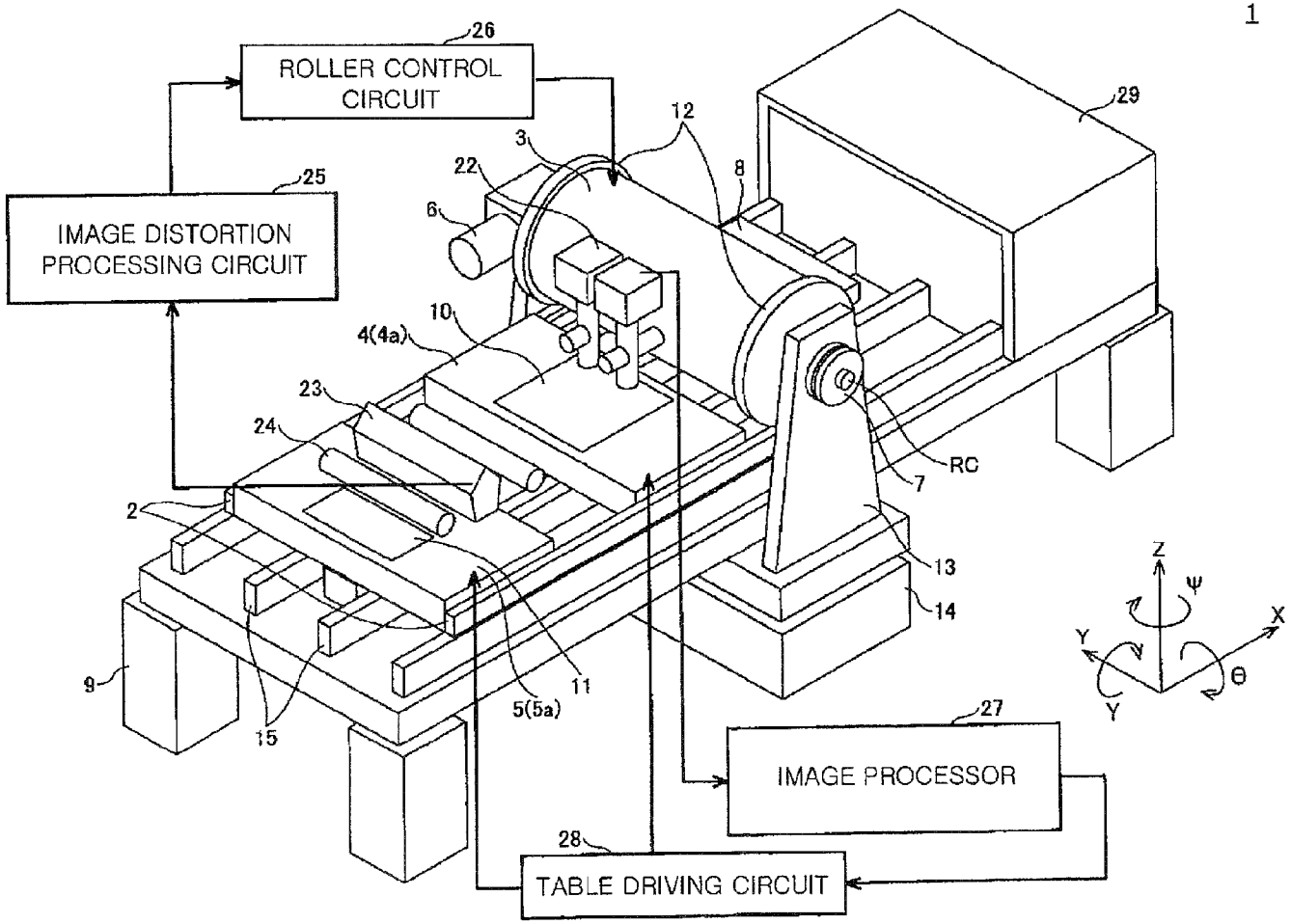
FIG. 1 is a perspective view presenting a schematic configuration of a printing device in accordance with a first embodiment of the present invention.

FIG. 1 is a perspective view presenting a schematic configuration of a printing device 1 in accordance with the present embodiment.

The printing device 1 includes a roller transfer cylinder 3. Tables 4 and 5, which are connected with each other, are installed above a main body 9 of the printing device 1 in a movable manner. On the table 4, a master plate (i.e., a plate-shaped printing block) 10 is mounted. Further, on the table 5, a work plate (i.e., a film of a plate-shaped body) 11 is mounted.

The master plate 10 of a flat plate shape is provided with a protruding reverse pattern reversed to a pattern to be printed on the work plate 11. The master plate 10 is fixedly maintained on the table 4, and removes ink corresponding to the reverse pattern from the roller transfer cylinder 3 of which whole surface is coated with ink, by transferring.

The work plate 11 is an object to be printed of a flat plate shape which is formed with a glass substrate, a film substrate or the like. Ink corresponding to a printing pattern is transferred from the roller transfer cylinder 3 to the work plate 11, which is fixedly maintained on the table 5. Further, the table 5 is the supporting unit in the present invention.

The roller transfer cylinder 3 may be a blanket cylinder of which periphery is wrapped with a water repellent blanket 16 formed with, e.g., silicone, as described later with reference to FIG. 2. Further, as the following description made by referring to FIG. 5, the roller transfer cylinder 3 may include a base material 31 formed with, e.g., a metal, an elastic material 32 formed with, e.g., polyurethane, and a resin sheet 33 formed with, e.g., silicone resin, on which ink is coated. The resin sheet 33 may be the water repellent blanket 16.

A rotational shaft RC of the roller transfer cylinder 3 is held by bearings which are fixed to brackets 13. Between the brackets 13 and both sides of the roller transfer cylinder 3, pinions 12 are attached. The pinions 12 and the rotational shaft RC are rotated together or separately by a clutch 7, which will be described later. Racks 2 are provided above the main body 9 to be engaged with the pinions 12. The brackets 13 may move up and down by an elevation mechanism 14. Accordingly, the racks 2 and pinions 12 may be in one of three statuses of engagement, contact without engagement, and separation.

As shown in FIG. 1, the racks 2 and the pinions 12 may be installed at both sides of the roller transfer cylinder 3 in the present embodiment. Thus, rattling generated from the racks 2 and the pinions 12 can be reduced, and an accuracy in a position alignment can be improved when the roller transfer cylinder 3 is aligned with the master plate 10, or the work plate 11. One end of the roller transfer cylinder 3 is connected with a driving unit 6 for rotation driving which is fixed to the bracket 13, and the clutch 7 is attached to the other end of the roller transfer cylinder 3. When the clutch 7 is engaged with the pinion 12, the pinion 12 rotates together with the roller transfer cylinder 3, but when the clutch 7 is released therefrom, the roller transfer cylinder 3 rotates alone. Further, an ink coater 8 for coating ink on the surface of the roller transfer cylinder 3 is fixed to the brackets 13.

Linear guides 15 as linear-motion bearings are fixed on the main body 9 to be parallel with the racks 2, and the tables 4 and 5 connected with each other are positioned on the linear guides 15 to be movable thereon. Further, linear-motion bearings are also provided under the pinions 12, so that stiffness of each of the tables 4 and 5 is prevented from being deteriorated.

The tables 4 and 5 are assembled with six axis driving mechanisms 4*a* and 5*a* which move the master plate 10 and the work plate 11 respectively mounted thereon in X, Y and Z directions, and θ, Y and Ψ rotational directions around respective X, Y and Z axes. Intervals in the Z direction, deviations in the X direction, inclinations in the direction, distances in the Y direction of the master plate 10 and the work plate 11 relative to the roller transfer cylinder 3 can be adjusted by employing the six axis driving mechanisms 4*a* and 5*a*, respectively.

Further, the six axis driving mechanisms 4*a* and 5*a* correspond to an adjusting mechanism in accordance with the embodiments of the present invention.

Figure 2A:
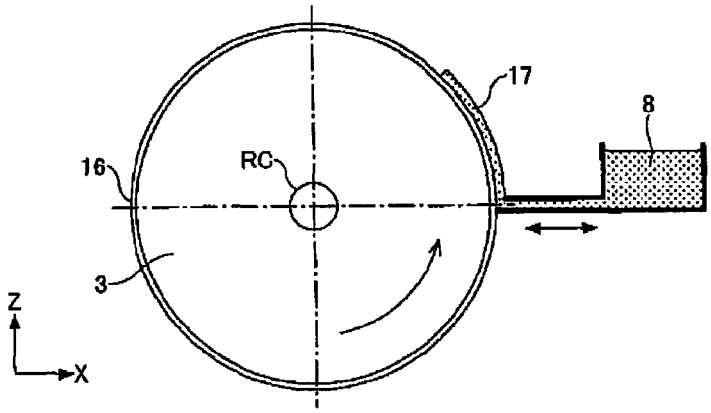
FIGS. 2A to 2C are schematic cross sectional views for describing an operation of the printing device in accordance with the first embodiment of the present invention.
Figure 2B:
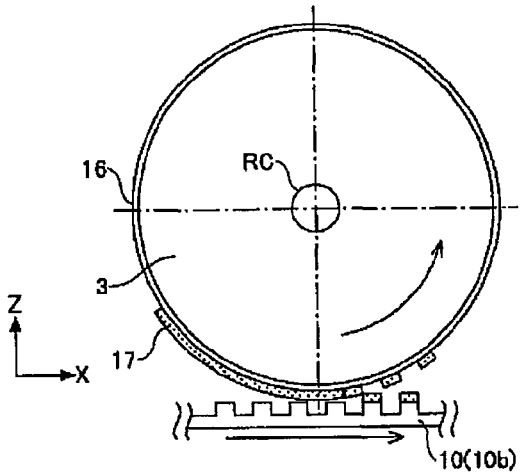
Figure 2C:
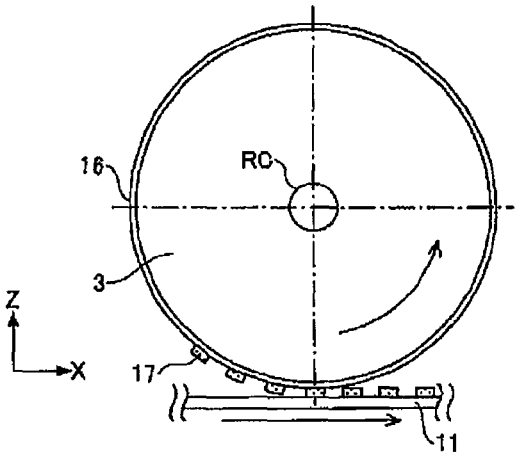

FIGS. 2A to 2C are schematic cross sectional views for describing an operation of the printing device 1 in accordance with the present embodiment.

First, the connected tables 4 and 5 are returned to be located at original positions (i.e., the status of the tables 4 and 5 in FIG. 1), and the master plate 10 and the work plate 11 are placed and fixed on predetermined positions on the tables 4 and 5, respectively. The master plate 10 and the work plate 11 may be fixed by, e.g., a vacuum chuck, a mechanical fixing method or the like.

Then, the six axis driving mechanisms 4*a* and 5*a* respectively assembled in the tables 4 and 5 are operated to adjust the intervals in the Z direction, the deviations in the X direction and the inclinations in the θ direction, distances in Y direction of the master plate 10 and the work plate 11 relative to the roller transfer cylinder 3, and the like. Thereafter, tables 4 and 5 are simultaneously moved in the X direction with the rotation of the roller transfer cylinder 3, so that ink can be transferred (printed) from the roller transfer cylinder 3 to the master plate 10 on the table 4 or the work plate 11 on the table 5, when the roller transfer cylinder 3 rotates on the table 4 or 5.

Then, the elevation mechanism 14 is operated to move up the brackets 13, so that teeth of the racks 2 and pinions 12 are completely separated not to be engaged. Then, in the state that the clutch 7 is released from the pinion 12, the roller transfer cylinder 3 is rotated by the driving unit 6 to be at an original position. Thereafter, as shown in FIG. 2A, the ink coater 8 is moved to be positioned close to the roller transfer cylinder 3 at a predetermined position, so that a gap between a leading end of the ink coater 8 and the surface of the roller transfer cylinder 3 is set to be a preset value. In this state, the roller transfer cylinder 3 is rotated, and thus, an ink film 17 of a specific thickness is formed on a required region in the surface of the roller transfer cylinder 3 by using the meniscus method. After forming the ink film 17, the ink coater 8 is returned to a specified position.

The roller transfer cylinder 3 is further rotated to a specific position, and the clutch 7 is engaged with the pinion 12. Then, the brackets 13 are moved down by operating the elevation mechanism 14, so that the pinions 12 are engaged with the racks 2. Thereafter, the roller transfer cylinder 3 is moved together with the table 4 by operating the driving unit 6. Since the racks 2 and pinions 12 are engaged with each other and a radius of the roller transfer cylinder 3 and that of each pinion 12 are equal, a rotational speed of the periphery of the roller transfer cylinder 3 and a moving speed of the table 4 becomes equal. Accordingly, the master plate 10 moves while the protrusion portion 10*b* thereof contacts with the ink film 17 coated on the roller transfer cylinder 3 in a contact area linearly extended along the direction of the rotational shaft RC and takes out the contacted ink.

As a result, a pattern reversed to that formed on the master plate 10 remains on the surface of water repellent blanket 16 of the roller transfer cylinder 3, and thus, a printing pattern is formed as shown in FIG. 2B.

Then, the brackets 13 are moved up by operating the elevation mechanism 14, so that the engagement between the racks 2 and the pinions 12 are released. Next, the roller transfer cylinder 3 is rotated to a specific position, and the brackets 13 are moved down again by operating the elevation mechanism 14 to engage the racks 2 and pinions 12. Thereafter, the roller transfer cylinder 3 simultaneously moves with the table 5 by operating the driving unit 6 to transfer the ink from the water repellent blanket 16 to the work plate 11, as shown in FIG. 2C.

By repeatedly performing the above-described operations, patterns are printed to be superimposed on the work plate 11, so that a desirable structure can be produced. When the patterns are printed to be superimposed on the work plate 11, position alignment with respect to a pattern, which has been previously printed, is performed first. A position alignment mark is formed on the master plate 10 and it is transferred to the roller transfer cylinder 3 as well as a printing pattern to be corresponded with other patterns. The position alignment mark transferred to the roller transfer cylinder 3 is further transferred to the work plate 11. The position alignment mark transferred to the work plate 11 and that transferred to the roller transfer cylinder 3 are controlled to be corresponded, so that the patterns are printed to be precisely superimposed.

Figure 3A:
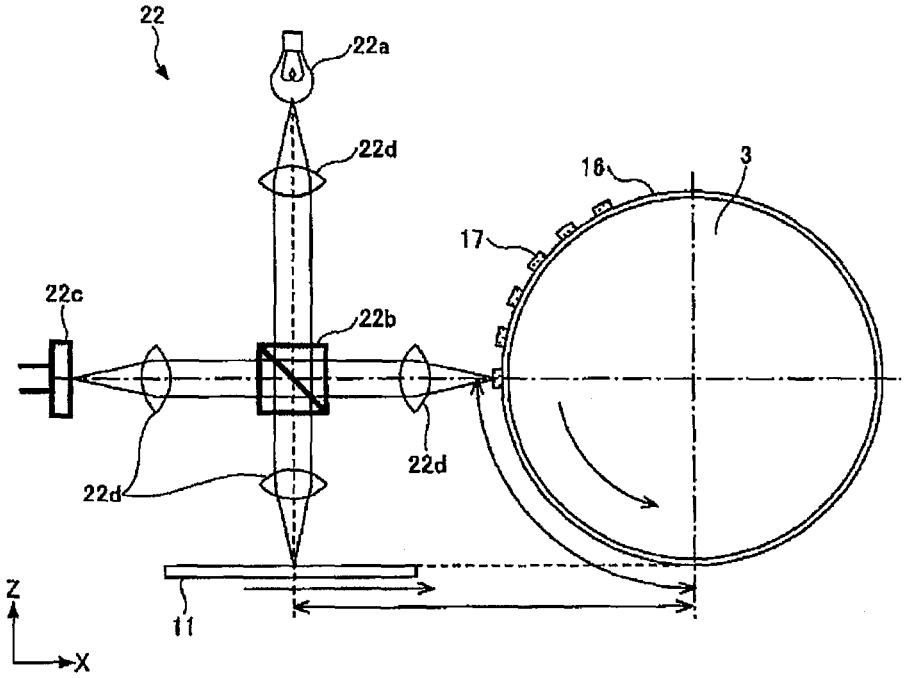
FIG. 3A is a cross sectional view showing a schematic structure of a mark detection unit and FIG. 3B is a diagram presenting an example of image information obtained by a CCD detection unit.
Figure 3B:
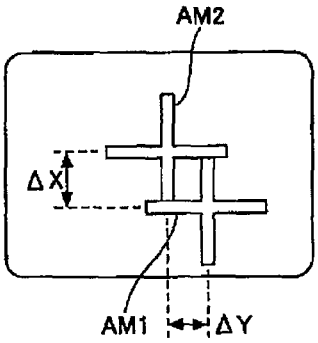

FIG. 3A is a cross sectional view showing a schematic structure of a mark detection unit 22, and FIG. 3B is a diagram presenting an example of image information obtained by a CCD detection unit.

Further, the mark detection unit 22 and the six axis driving mechanisms 4*a* and 5*a* form a position alignment mechanism in the embodiments of the present invention.

In the vicinity of a contact position of the roller transfer cylinder 3 and the table 5, the mark detection unit is provided which is capable of observing a position alignment mark AM1 formed on the surface of the roller transfer cylinder 3 and a position alignment mark AM2 formed on the work plate 11 which is mounted on the table 5, simultaneously. The mark detection unit 22 includes a strobe light source 22*a*, a half mirror 22*b*, and a CCD (Charge Coupled Device) detection unit 22*c*. When the roller transfer cylinder 3 and the table 5 are operated together, the mark detection unit 22 picks-up and observes images of the respective position alignment marks AM1 and AM2.

The strobe light source 22*a* emits a light in order to observe a moving object. The emitted light from the strobe light source 22*a* is incident upon the half mirror 22*b* as a form of a parallel beam through a lens 22*d*. The incident light upon the half mirror 22*b* are divided into two lights of different directions, one of which is bent at about ninety degrees by being reflected by the half mirror 22*b* and reaches the roller transfer cylinder 3, and the other of which transmits through the half mirror 22*b* straightly to reach the work plate 11 on the table 5. Further, the former is reflected by the roller transfer cylinder 3 and transmits through the half mirror 22*b* straightly, while the latter is reflected by the work plate 11 and bent at ninety degrees by being reflected by the half mirror 22*b*, and then, two lights are mixed with the light. The mixed light proceeds to the CCD detection unit 22*c*.

The CCD detection unit 22*c* receives the light mixed by the half mirror 22*b*, and therefore, it images the position alignment mark AM1 in the patterns formed on the roller transfer cylinder 3 and the position alignment mark AM2 formed on the work plate 11. In detail, an image processor 27 performs image synthesis based on signals detected by the CCD detection unit 22*c*. Then, an operation of the six axis driving mechanism 5*a* is controlled by a control unit (not shown) based on the images taken by the CCD detection unit 22*c*, and thus, a relative position between the work plate 11 and the roller transfer cylinder 3 is aligned. Further, the CCD detection unit 22*c* may be set to image the position alignment mark AM1 in the patterns formed on the roller transfer cylinder 3 and the position alignment mark AM2 formed on the work plate 11 only when the strobe light source 22*a* emits a light.

Under the condition that no rattling is generated by the racks 2, the pinions 12 and the like and the work plate 11 is aligned in a precise position on the table 5, the position alignment marks AM1 and AM2 of the roller transfer cylinder 3 and the work plate 11 are previously adjusted, so that they can be precisely superimposed in the image obtained by the CCD detection unit 22*c*. Therefore, when the position alignment is not precise, the position alignment mark AM1 is deviated in X and Y directions by amounts of ΔX and ΔY from the position alignment mark AM2 due to sliding or rattling generated from the clutch 7, the racks 2 and the pinions 12 or a dimension tolerance of the each unit, as shown FIG. 3B.

Herein, e.g., a case where ink coated on the surface of the roller transfer cylinder 3 is transferred to the work plate 11 maintained on the table 5 is considered. The deviation amounts described above are fed back to a table driving circuit 28, and the relative position between the work plate 11 and roller transfer cylinder 3 is aligned to superimpose the position alignment marks AM1 and AM2 by the six axis driving mechanism 5*a*, before the work plate 11 and the roller transfer cylinder 3 are contacted. As a result, a movement distance of the work plate 11 and a rotation distance of the surface of the roller transfer cylinder 3 become same when the roller transfer cylinder 3 is rotated on the work plate 11 maintained on the table 5. Further, the ink is transferred from the surface of the roller transfer cylinder 3 to be printed on the work plate 11 in a status in which the relative position between the work plate 11 and the roller transfer cylinder 3 is precisely aligned.

Figure 4A:
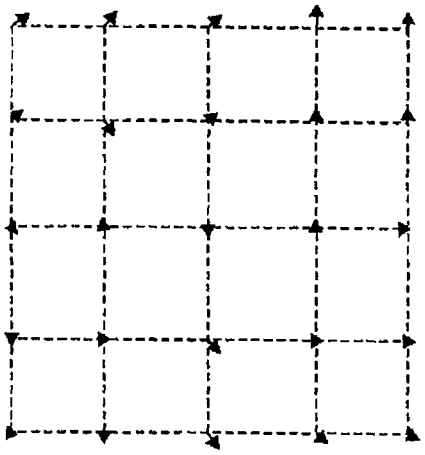
FIGS. 4A and 4B show examples of deformation and distortion maps obtained by a substrate deformation/distortion measurement unit.
Figure 4B:
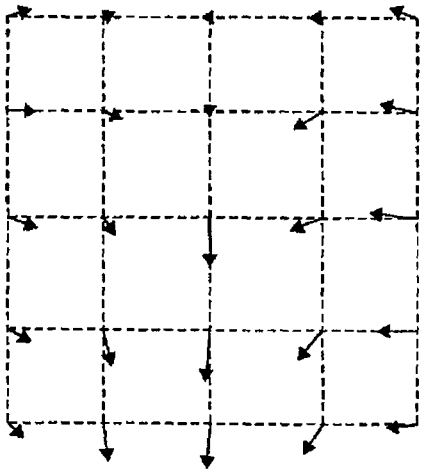

FIGS. 4A and 4B show examples of deformation and distortion maps obtained by a substrate deformation/distortion measurement unit 23. Further, in FIGS. 4A and 4B, directions of arrows present directions of deviation of position alignment marks AM2 which are positioned at respective cross points where horizontal and vertical lines cross, and lengths of the arrows present sizes of the deviations (i.e., deviation amounts) of the position alignment marks AM2 at the respective cross points.

The substrate deformation/distortion measurement unit 23 is installed between the tables 4 and 5, so that deformation amounts in the master plate 10 mounted on the table 4 or those in the work plate 11 mounted on the table 5 can be measured while the tables 4 and 5 move.

The substrate deformation/distortion measurement unit includes an optical lens group and a TDI (Time Delay Integration) sensor and obtains an image of the surface of the master plate 10 or that of the work plate 11, which is lit by illuminations 24 disposed at both sides of the substrate deformation/distortion measurement unit 23. Even when the master plate 10 or the work plate 11 moves, an image having a high S/N ratio can be obtained by using the TDI sensor. Image data obtained by the substrate deformation/distortion measurement unit 23 is transmitted to an image distortion processing circuit 25, thereby obtaining the deformation and distortion map of the master plate 10 or the work plate 11, as shown in the example of FIG. 4A.

In the image distortion processing circuit 25, a linear distortion component (hereinafter, also referred to as "linear distortion mode") is extracted from the deformation and distortion map, and a correction amount of pressing amount h, which will be described later in detail, is sent to a roller control circuit 26, based on the extracted linear distortion mode. The roller control circuit 26 controls the pressing amount h based on the correction amount sent from the image distortion processing circuit 25. Therefore, the pattern on the water repellent blanket 16 can be desirably extended or contracted in the X direction, i.e., the rotational direction of the roller transfer cylinder 3, and thus, the printing pattern is prevented from being deviated from the design dimension of device.

As shown in FIG. 4B, if great linear distortions are generated on the work plate 11, patterns printed to be superimposed on a printed pattern as a base may become gradually deviated. In the present embodiment, however, the linear distortions generated on the work plate 11 are corrected, so that patterns can be printed to be superimposed on a printed pattern as a base while reducing deviation amounts therebetween.

In the printing device 1 in accordance with the present embodiment, the substrate deformation/distortion measurement unit 23 is installed in the printing device 1. However, the substrate deformation/distortion measurement unit 23 may be provided separately from the printing unit 1 to measure the deformation amounts in the master plate 10 or those in the work plate 11 and the resultant measurement information may be input to the printing device 1.

On the main body 9, a cleaning unit 29 is provided on an opposite side of the tables 4 and 5 with respect to the roller transfer cylinder 3 such that the roller transfer cylinder 3 interposes between the cleaning unit 29 and the tables 4 and 5. The linear guides 15 are extended into the cleaning unit 29. When ink is transferred from the roller transfer cylinder 3 to the work plate 11 on the table 5, the master plate 10 on the table 4 gets into the cleaning unit to be cleaned therein. Since ink is coated on the surface of the protrusion portion 10*b* of the master plate 10, it is removed by using, e.g., an adhesive roller. After removing the unnecessary ink by using the adhesive roller, organic cleaning, ionized air blowing, a surface energy adjustment by UV (Ultra Violet) light irradiation and the like are performed onto the surface of the master plate 10. Since the cleaning process is performed in the midst of ink transferring from the roller transfer cylinder 3 to the work plate 11, a preparation for next printing is completed without spending an extra time for cleaning.

Figure 5:
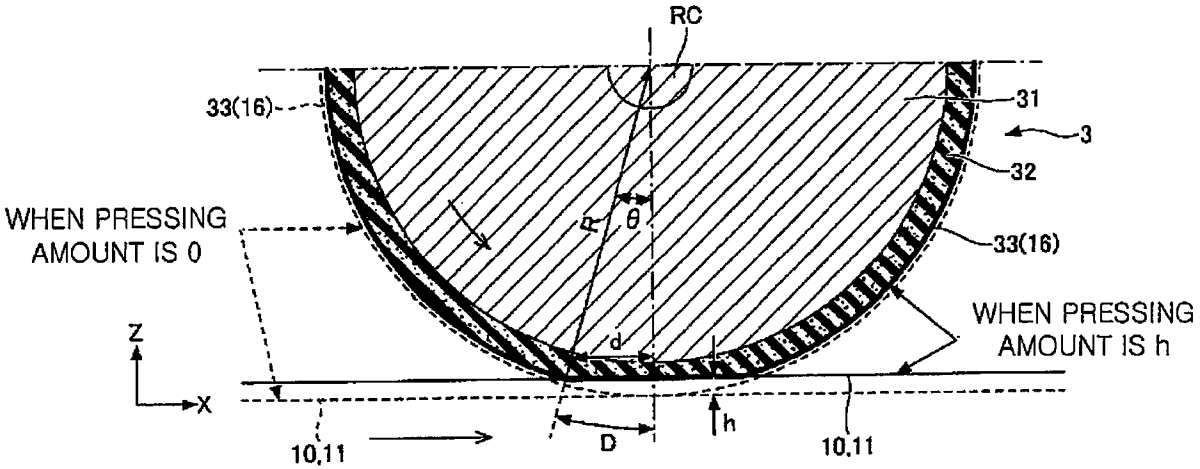
FIG. 5 is an enlarged view of a contact status between a roller transfer cylinder and a master plate or a work plate.
Figure 6:
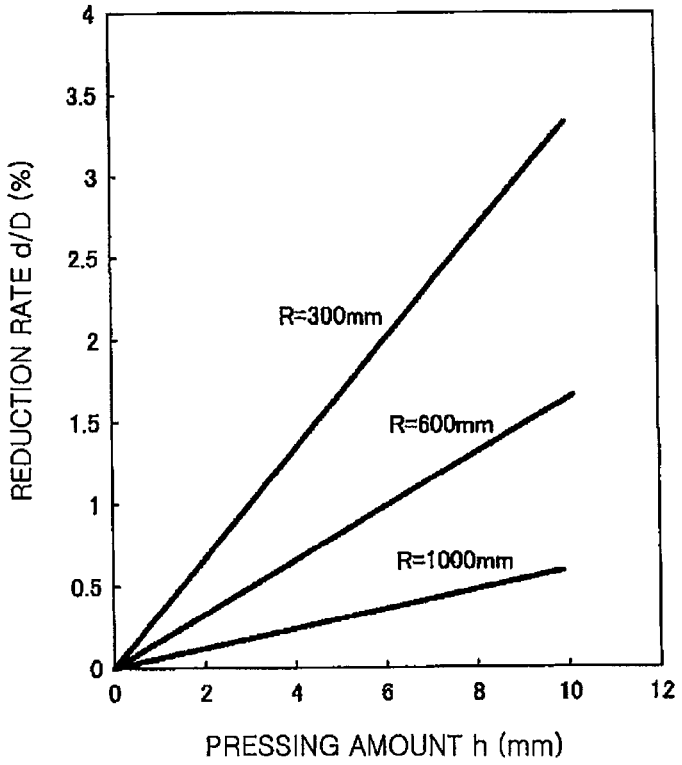
FIG. 6 is a graph presenting a relationship between a pressing amount h and a reduction rate d/D.

FIG. 5 is an enlarged view of a contact status between the roller transfer cylinder 3 and the master plate 10 or the work plate 11. Further, FIG. 6 is a graph presenting a relationship between a pressing amount h and a reduction rate d/D.

In FIG. 2, although irregularity, i.e., the protrusion portion 10*b* of the master plate 10, is exaggeratingly shown, it is not shown in FIG. 5 because the height of the irregularity is in the order of several microns.

As shown in FIG. 5, a base material of the roller transfer cylinder 3 is the base material 31 formed with, e.g., a metal. The periphery of the base material 31 is provided with the elastic material 32 formed with e.g., polyurethane, and the peripheral surface of the elastic material 32 is provided with the resin sheet 33 formed with, e.g., silicone.

A Z-directional position in which the master plate 10 or the work plate 11 is maintained by the table 4 or 5 is controlled to press the master plate 10 or the work plate 11 into the roller transfer cylinder 3 when the master plate 10 or the work plate 11 makes contact with the roller transfer cylinder 3. This is because the ink may be not transferred onto a whole surface of the master plate 10 or the work plate 11 due to a flatness of the surface of the table 4 or 5, a positional precision of a moving table, a flatness of the surface of the roller transfer cylinder 3 or the like if the master plate 10 or the work plate 11 is not pressed into the roller transfer cylinder 3 (i.e., h=0.0).

In the present embodiment, the printing is performed between the roller transfer cylinder 3 and the master plate 10 or the work plate 11 in a state that the Z-directional position where the master plate 10 or the work plate 11 is maintained by the table 4 or 5 is controlled by the six axis driving mechanism 4*a* or 5*a* to make the pressing amount h of the master plate 10 or the work plate 11 against the roller transfer cylinder 3 be a positive value. When the pressing amount h becomes a positive value, the elastic material 32, which is the softest material of the roller transfer cylinder 3, is nipped. Accordingly, even in a case where the pressing amount is changed while the ink is transferred, the ink may be securely transferred.

Further, the relative position of the master plate 10 or the work plate 11, which is maintained by the table 4 or 5, with respect to the roller transfer cylinder 3 may be controlled. Furthermore, the Z-directional position of the roller transfer cylinder 3 may be also controlled.

Herein, a case, in which the radius of the roller transfer cylinder 3 is defined as "R", the roller transfer cylinder 3 is nipped by the pressing amount h, and the work plate 11 and the roller transfer cylinder 3 are contacted by a surface contact, is considered. Further, as shown in FIG. 5, a portion of the roller transfer cylinder 3 is in a surface contact status with the work plate 11 along the moving direction (X direction) of the work plate 11, i.e., the rotational direction of the roller transfer cylinder 3, and has a length of "2d". Moreover, a length of a circular arc, which is a shape of the portion of the roller transfer cylinder 3 when it is not in the surface contact status, is "2D", and a central angle corresponding to the length of 2D is 2θ. When θ has a minute value, D is presented in R×θ (i.e., D=R×θ). When the roller transfer cylinder 3 is rotated by θ, a pattern of ink coated on a circular arc of a length of R×θ, i.e., a circular arc of a length of D, is reduced into a length d to be transferred along the moving direction (i.e., X direction) of the work plate 11.

As shown in FIG. 6, the reduction rate d/D is a function of R and h and becomes smaller as the radius R becomes larger or the pressing amount h becomes smaller. Since the radius R is constant, the reduction rate d/D of the pattern along the moving direction (X direction) of the work plate 11 is desirably controlled by adjusting the pressing amount h. Thus, by adjusting the pressing amount h of the work plate 11 against the roller transfer cylinder 3 by the six axis driving mechanism 5*a*, the printing pattern is prevented from being deviated from a design dimension of a device due to a change in the contact status between the work plate 11 and the roller transfer cylinder 3 and the pattern is printed with a high dimensional accuracy.

Further, in a case where the ink is removed from the roller transfer cylinder 3 by the master plate 10, when the roller transfer cylinder 3 is rotated by θ, the ink is removed from the roller transfer cylinder 3 in a status in which the pattern on the circular arc of the length of R×θ (i.e., length D) is reduced to have a length of d along the moving direction (X direction) of the master plate 10. However, when the contact between the roller transfer cylinder 3 and the master plate 10 is completed, i.e., when the ink is completely removed, the deformation of the elastic material 32 is recovered, and thus, the diameter of the roller transfer cylinder 3 returns to its original size. Accordingly, the reduced pattern is enlarged to be same as a dimension of the pattern on the master plate 10. With this, no deviation in the dimension of pattern occurs when the ink is removed by the master plate 10.

Further, the printing device 1 may further include, e.g., an operation unit, a storage unit and a display unit, which are not shown. The operation unit may be a computer having, e.g., CPU (Central Processing Unit). The storage unit may be a computer-readable storage medium, such as, e.g., a hard disk or the like, and store therein programs for executing a variety of processes on the operation unit. The display unit may be formed with, e.g., a computer screen. The operation unit reads out a program stored in the storage unit, transmits control signals to respective units configuring the printing device 1, and executes a printing method which will be described below.

Hereinafter, the printing method in accordance with the present embodiment is described.

Figure 7:
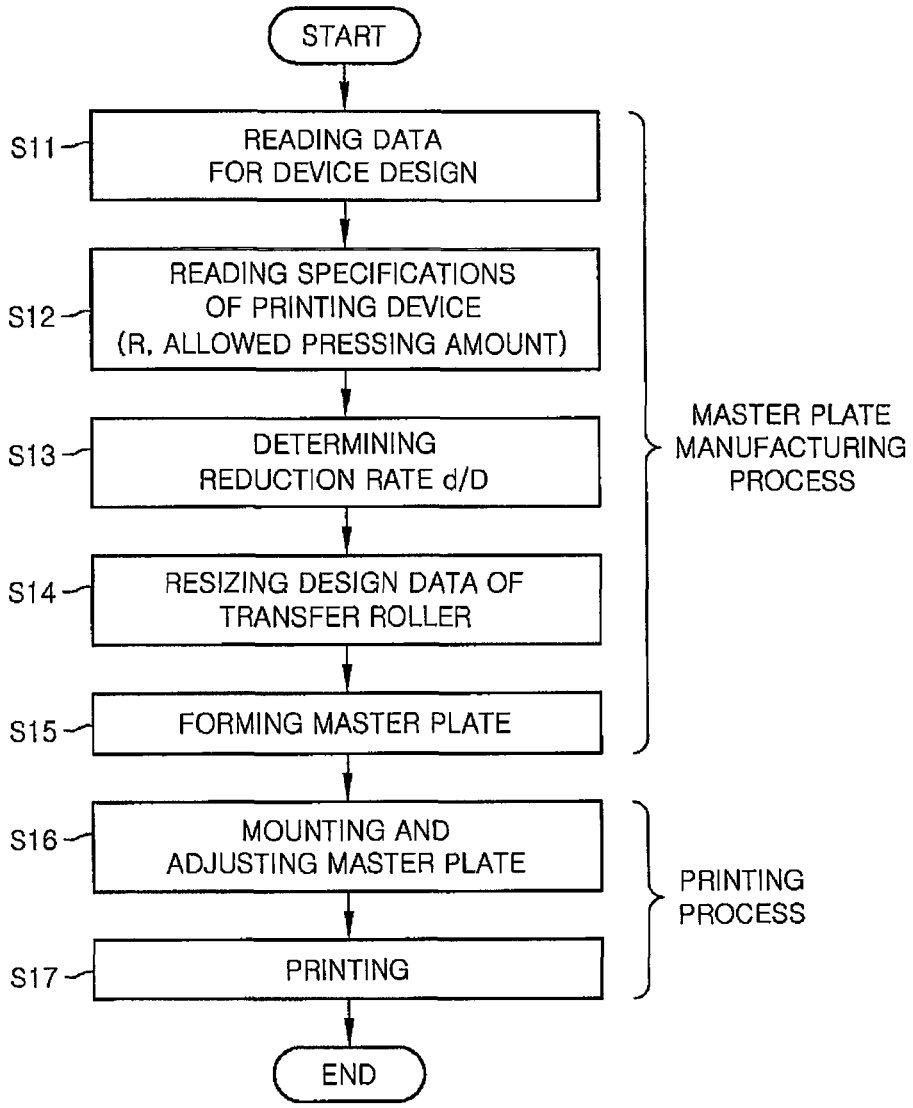
FIG. 7 is a flowchart presenting a sequence of processes in a printing method in accordance with the first embodiment of the present invention.

FIG. 7 is a flowchart presenting a sequence of processes in a printing method in accordance with the present embodiment.

Print processing by the printing method in accordance with the present embodiment is classified into two great processes, i.e., a master plate manufacturing process and a printing process.

In the master plate manufacturing process, the master plate 10 is manufactured based on data for device design, specifications of the printing device 1 and the like.

First, the data for device design is read from a memory unit provided, e.g., in the printing device 1 or provided separately from the printing device 1, in step S11.

Next, the specifications of the printing device 1 are read from, e.g., the memory unit described above, in step S12. The specifications of the printing device 1 may include, e.g., the diameter of the roller transfer cylinder 3, the pressing amount h allowed with respect to the elastic material 32, in step S12.

Thereafter, the reduction rate d/D is determined based on the diameter and the pressing amount h allowed with respect to the elastic material 32, in step S13. For example, when the diameter of the roller transfer cylinder 3 is 1200 mm (i.e., R=600 mm) and the thickness of the elastic material 32 is 5 mm, the allowed pressing amount h is adjusted to be in a range of 1.5±0.5 mm. When the pressing amount h has an intermediate value of the range, i.e., 1.5 mm, the reduction rate d/D becomes 0.25%, as shown in the graph of FIG. 6.

Then, in step S14, pattern data of the master plate 10 is made by being increased by 0.25% in advance, so that dimension of the roller transfer cylinder 3 in a rotational direction corresponds to a design dimension of the device (data resizing process) when the pressing amount h is 1.5 mm.

Next, a pattern of a protrude portion is formed in a quartz plate by using, e.g., a photolithography technique based on the generated pattern data in step S15. Through a series of the steps, the master plate 10 is formed.

In the printing process, first, the master plate 10 is mounted on the table 4, and the posture of the table 4 is adjusted by the six axis driving mechanism 4*a* to set the pressing amount h of the master plate 10 against the roller transfer cylinder 3 to be about 1.5 mm. Then, the work plate 11 is mounted on the table 5, and the posture of the table 5 is adjusted by the six axis driving mechanism 5*a* to set the pressing amount h of the master plate 11 against the roller transfer cylinder 3 to be about 1.5 mm in step S16 (adjusting process).

Next, as the description made above by referring to FIGS. 2A to 2C, printing is performed based on the reverse off-set printing method in step S17, which is a substantial printing process. At this time, the relative position between the master plate 10 maintained on the table 4 and the roller transfer cylinder 3 is aligned by the mark detection unit 22 and the six axis driving mechanism 4*a*, as described by referring to FIGS. 3A and 3B. Further, the relative position between the work plate 11 maintained on the table 5 and the printing pattern formed on the roller transfer cylinder 3 is aligned (position alignment process).

In the printing device 1 in which the position alignments have been made, when the pressing amount h is the intermediate value, i.e., 1.5 mm, the pattern of a dimension same as a design dimension of the device can be printed. Further, when the pressing amount h is increased from the intermediate value, the printing pattern can be printed to be contracted in the X direction, and when the pressing amount h is reduced from the intermediate value, the printing pattern can be printed to be extended in the X direction. That is, the pattern to be printed on the work plate 11 is contracted/extended along the rotational direction of the roller transfer cylinder 3.

For example, when the pressing amount h is changed in an allowable range of ±0.5 mm from the intermediate value, the printing pattern can be contracted/extended by ±0.083%. Accordingly, when an extensible/contractible amount has been known, the printing can be performed while correcting the extensible/contractible amount.

Figure 8A:
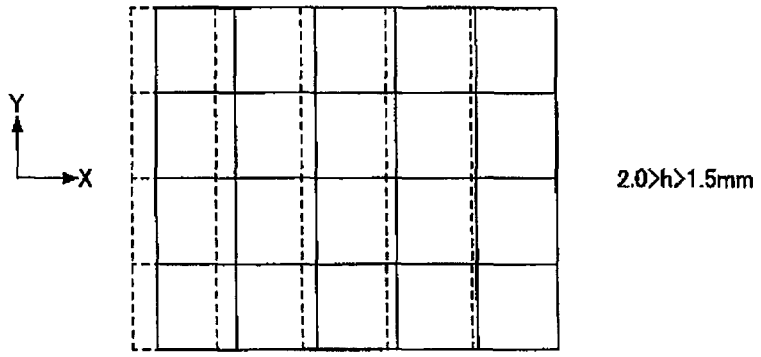
FIGS. 8A to 8C show patterns (solid lines) printed on the work plate and patterns (broken lines) based on a design dimension.
Figure 8B:
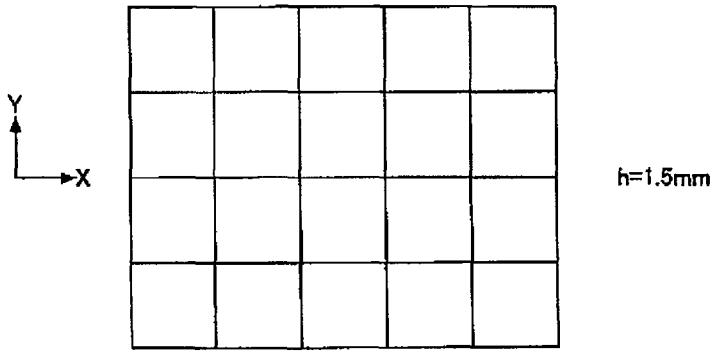
Figure 8C:
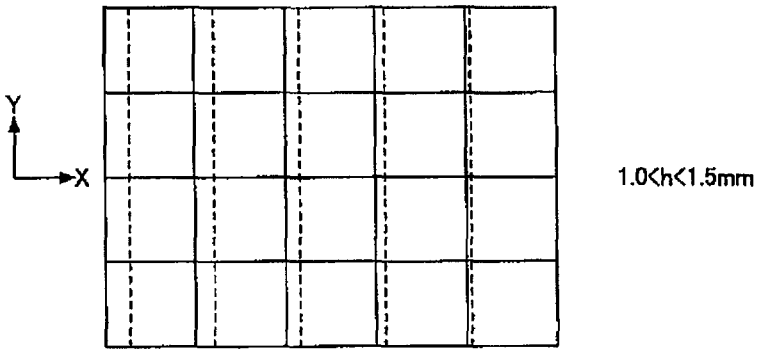

FIGS. 8A to 8C show patterns (solid lines) printed on the work plate 11 and patterns (broken lines) based on a design dimension, together. FIGS. 8A to 8C present cases where printings are performed by setting the pressing amount h to be greater than, same as, and smaller than 1.5 mm, respectively.

The printed pattern in FIG. 8B is of a same dimension as the design dimension, that (solid lines) in FIG. 8A is contracted comparing with the design dimension (broken lines), and that (solid lines) in FIG. 8C is extended comparing with the design dimension (broken lines). Therefore, the printing pattern can be desirably extended/contracted with respect to the design dimension by adjusting the pressing amount h.

[First Modification of the First Embodiment]

Next, a printing method in a first modification of the first embodiment in accordance with the present invention is described.

In the first embodiment, the extensible/contractible amount of the pattern printed on the work plate is uniform in the surface of the work plate along the rotational direction of the roller transfer cylinder. However, the deviation amount of the printing pattern from the design dimension may be changed in the surface of the work plate without being uniform along the rotational direction of the roller transfer cylinder. In the present modification, there is described the printing method in which correction is made, before performing printing, to allow a linear change in extensible/contractible amount of a printing pattern in the surface of the work plate along the rotational direction of the roller transfer cylinder.

In the present modification, the printing device 1 in accordance with the first embodiment can be used, and therefore, a detailed description on the printing device 1 is omitted.

Figure 9:
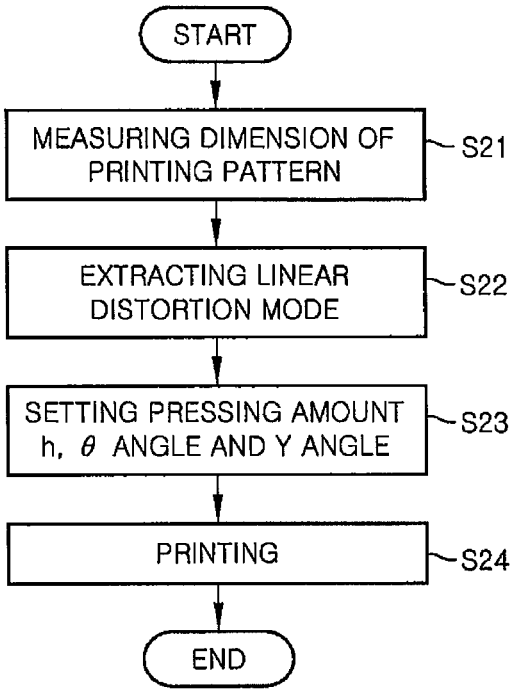
FIG. 9 is a flowchart presenting a sequence of processes in a printing method in accordance with a first modification of the first embodiment.

FIG. 9 is a flowchart presenting a sequence of processes in the printing method in accordance with the present modification.

First, a dimension of a pattern is measured with respect to the work plate 11 on which the pattern has been printed by a dimension measuring device (not shown) in step S21. Extraction of the linear distortion mode performed at next step may be currently performed based on the measurement data obtained, wherein the dimension measurement may be executed by the substrate deformation/distortion measurement unit 23 installed in the printing device 1 or by a dimension measurement device provided separately from the printing device 1.

Then, the measurement data obtained is analyzed, and the linear distortion mode is extracted in step S22. That is, the surface of the master plate 10 or that of the work plate 11 is imaged to take the deformation and distortion map, and the linear distortion mode is extracted from the deformation and distortion map.

Thereafter, a position in a Z direction (corresponding to the pressing h), a θ angle, a Y angle required for controlling the six axis driving mechanisms 4*a* and 5*a* are set based on the extracted linear distortion mode in step S23. Then, the six axis driving mechanisms 4*a* and 5*a* are controlled to obtain the set values.

Then, the master plate 10 and work plate 11 are mounted on the tables 4 and 5, respectively, and the substantially printing treatment in the printing process of the flowchart shown in FIG. 7 is performed in step S24.

By adjusting the position in the Z direction, e.g., an average reduction rate may be corrected in the surface of the work plate 11. Further, a linear change in a reduction rate along the moving direction (X direction) of the table 4 or 5 may be corrected by adjusting the Y angle. A linear change in a reduction rate along a direction (Y direction) orthogonal to the moving direction of the table 4 or 5 may also be corrected by adjusting the θ angle. After performing these corrections, the printing pattern can be printed to be superimposed on the work plate 11.

Although the printing is performed after adjusting the position in the Z direction, the θ angle, the Y angle, the printing may be performed while changing them. Accordingly, even when the extensible/contractible amount is minutely changed in the X direction, the printing pattern is prevented from being deviated from the design dimension of the device and the pattern is printed with a high dimensional accuracy.

[Second Modification of the First Embodiment]

Next, a printing method in a second modification of the first embodiment in accordance with the present invention is described.

In a printing method in accordance with the present modification, a property of each unit in the printing device, i.e., a geometric accuracy of the table mounting thereon the master plate and the table mounting thereon the work plate, is controlled, prior to performing the printing.

Further, the printing device 1 in accordance with the first embodiment is also utilized in the present modification, and thus, a detailed description on the printing device 1 is omitted.

Figure 10:
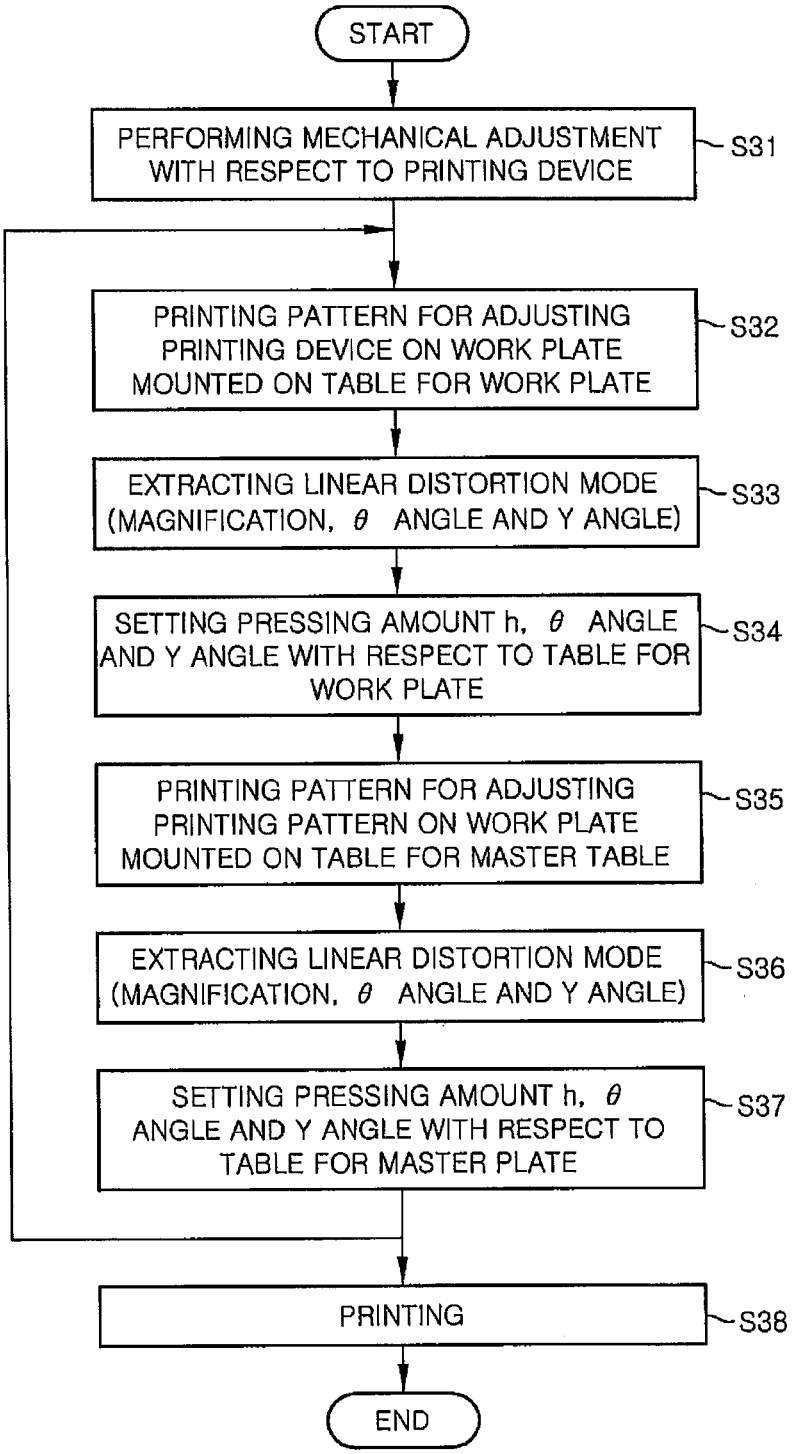
FIG. 10 is a flowchart showing a sequence of processes in a printing method in accordance with a second modification of the first embodiment.
Figure 11:
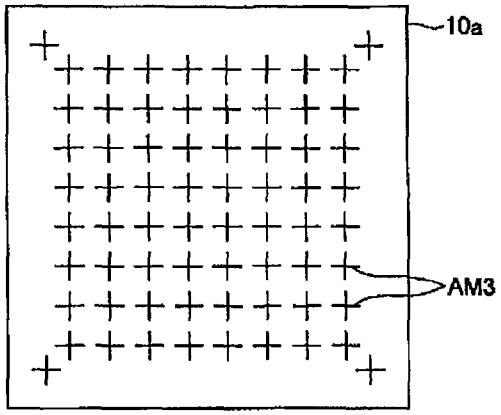
FIG. 11 is a plane view of a schematic configuration of a master plate for adjusting the printing device.

FIG. 10 is a flowchart showing a sequence of processes in the printing method in accordance with the present modification. FIG. 11 is a plane view of a schematic configuration of a master plate 10*a* for adjusting the printing device 1.

First, as shown in FIG. 11, a pattern for a dimension measurement is printed on the work plate 11 by using the master plate 10*a* on which a plurality of position alignment marks AM3 is formed. That is, mechanical adjustment with respect to the printing device 1 is performed in step S31, and the master plate 10*a* is positioned on the table 4 and the work plate 11 is mounted on the table 5. Then, the pattern for adjusting the printing device 1 is transferred from the master plate 10*a* to the roller transfer cylinder 3, and the transferred pattern for adjusting the printing device 1 is printed on the work plate 11 on the table 5 in step S32.

Then, a dimension of the pattern printed on the work plate 11 is measured by a dimension measurement device, such as the substrate deformation/distortion measurement unit 23 described above or the like, and the measurement data obtained is analyzed to extract a linear distortion mode in step S33. That is, the surface of the work plate 11 is imaged to obtain a deformation and distortion map, and the linear distortion mode is extracted from the deformation and distortion map. Further, a position in a Z direction (corresponding to pressing amount h), a θ angle, a Y angle required for controlling the six axis driving mechanism 5*a* are set based on the extracted linear distortion mode in step S34. Then, the six axis driving mechanism 5*a* is controlled to obtain the set values. That is, adjustment mechanisms for adjusting the θ angle, the Y angle and the position in the Z direction which are included in the six axis driving mechanism 5*a* are operated, and thus, an operating position of the table 5 with respect to the roller transfer cylinder 3 is adjusted to be constant, i.e., not to be changed.

Next, the master plate 10*a* is mounted on the table 5 which has been subjected to the adjustment, and the work plate 11 is placed on the table 4. Then, the pattern for adjusting the printing device 1 is transferred from the master plate 10*a* on the table 5 to the roller transfer cylinder 3, and the transferred pattern for adjusting the printing device 1 is printed on the work plate 11 on the table 4 in step S35.

Thereafter, the dimension of the pattern printed on the work plate 11 is measured by the dimension measurement device, such as the substrate deformation/distortion measurement unit 23 described above or the like, and the measurement data obtained is analyzed to extract a linear distortion mode in step S36. That is, the surface of the work plate 11 is imaged to obtain a deformation and distortion map, and the linear distortion mode is extracted from the deformation and distortion map. Further, a position in a Z direction (corresponding to pressing amount h), a θ angle, a Y angle required for controlling the six axis driving mechanism 4*a* are set based on the extracted linear distortion mode in step S37. Then, the six axis driving mechanism 4*a* is controlled to obtain the set values. That is, adjustment mechanisms for adjusting the θ angle, the Y angle and the position in the Z direction which are included in the six axis driving mechanism 4*a* are operated, and thus, an operating position of the table 4 with respect to the roller transfer cylinder 3 is controlled to be constant, i.e., not to be changed.

When a higher accuracy is required in the printing, these processes (i.e., step S32 to S37) are repeatedly performed for a number of times to establish a higher positional accuracy.

Accordingly, in step S38, the printing device 1 prints with a higher accuracy than the adjustment performed only by a mechanical adjustment jig, and the printing pattern is prevented from being deviated from the design dimension of the device, and the pattern is printed with high dimensional accuracy in step S38.

[Third Modification of the First Embodiment]

Hereinafter, a third modification of the first embodiment in accordance with the present invention is described.

A printing method in accordance with the present modification is for extending a life span of the resin sheet wrapping the roller transfer cylinder.

In the reverse off-set printing method, ink to be transferred to the work plate 11 remains in predetermined positions of the roller transfer cylinder 3, and the roller transfer cylinder 3 contacts with the work plate 11 in a status where a printing pressure is applied thereto to transfer the ink. Therefore, when an identical pattern is repeatedly printed, specific sites on the roller transfer cylinder 3 contact with ink for a long time period, and thus, swelling or the like occurs in the resin sheet 33 due to a solvent. Depending on existence of the swelling, printing durability in each area of the roller transfer cylinder 3 differs. For example, a life span in the area where the swelling occurs becomes shorter.

In order to solve such problem, a beginning position (contact starting position) between the roller transfer cylinder 3 and the table 4 for the master plate 10 may be changed thereby changing the position of the printing pattern on the surface of the roller transfer cylinder 3. In this case, since sites where ink remains on the roller transfer cylinder 3 are changed in each printing, degrees of swellings in the entire resin sheet 33 become uniform. As a result, swellings do not occur in the same sites, and thus, the life span of the resin sheet 33 is extended. Further, the entire resin sheet 33 has a uniform printing durability.

[Second Embodiment]

Hereinafter, a printing device in accordance with a second embodiment of the present invention will be described.

In the first embodiment, the example of correcting the deviation amount in the printing pattern along the moving direction of the work plate (X direction) is described. However, there is a case in which deviation in the printing pattern occurs along a direction orthogonal to the moving direction of the work plate, i.e., a direction of the rotational axis of the roller transfer cylinder (Y direction). In the present embodiment, description will be made on the printing device which prints a printing pattern after correcting a deviation amount in the printing pattern along the Y direction by contracting/extending the resin sheet of the roller transfer cylinder along the direction of the rotational axis of the roller transfer cylinder (Y direction) by an extension/contraction unit.

Further, in the printing device in accordance with the present embodiment, units other than the image distortion processing circuit 25 and an extension/contraction unit 34 are same as those in the printing device 1 in accordance with the first embodiment, and thus, description on the units other than the image distortion processing circuit 25 and the extension/contraction unit 34 is omitted.

Figure 12A:
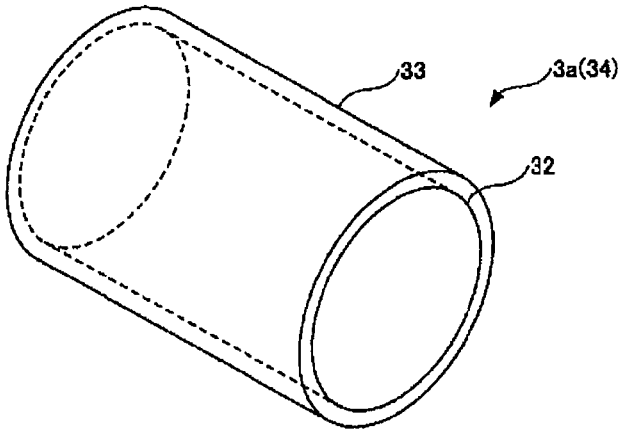
FIGS. 12A and 12B are perspective views of a disassembled extension/contraction unit of a printing device in accordance with a second embodiment of the present invention.
Figure 12B:
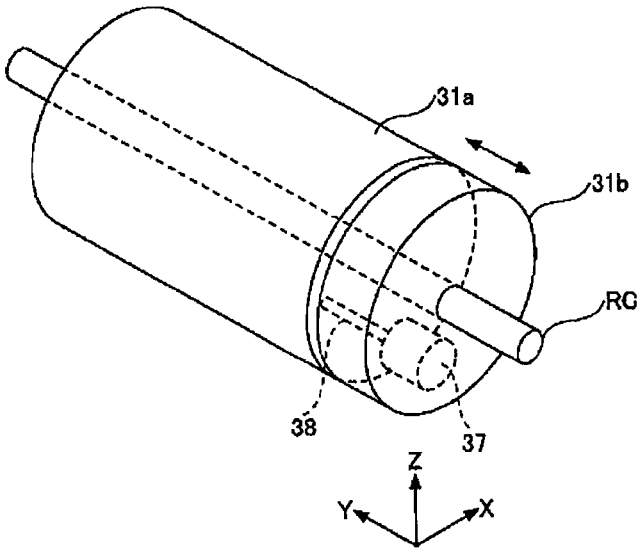

FIGS. 12A and 12B are perspective views of the disassembled extension/contraction unit 34 of a printing device in accordance with the present embodiment. FIG. 12A shows a structure of an elastic material 32 and a resin sheet 33, and FIG. 12B shows a structure of a base material 31.

The extension/contraction unit 34 includes a roller transfer cylinder 3*a*.

As shown in FIG. 12B, a base material of the roller transfer cylinder 3*a* is formed with a base material 31*a* and a base material 31*b*, and the base material 31*a* is fixed to a rotational axis RC. Meanwhile, the base material 31*b* is configured to be movable along the rotational axis RC, so that an interval between the base materials 31*a* and 31*b* is changeable by using, e.g., a spline bearing. Further, in the base material 31*b*, a motor 37 formed with, e.g., a pulse motor is installed, and the motor 37 is connected with a triangular thread 38 engaging with the base material 31*a* via a universal joint. The base material 31*b* is relatively moved with respect to the base material 31*a* by rotating the motor 37, and thus the interval between the base materials 31*a* and 31*b* is adjusted.

As shown in FIG. 12A, a periphery of the base materials 31*a* and 31*b* is provided with the elastic material 32 formed with, e.g., polyurethane. Further, a resin sheet 33 formed with, e.g., silicone, is provided on a peripheral surface of the elastic material 32.

One end of the elastic material 32 and the resin sheet is fixed to the base material 31*a* and the other end thereof is fixed to the base material 31*b*. Therefore, the resin sheet 33 is extended or contracted by controlling the interval between the base materials 31*a* and 31*b* by an operation of the motor 37. Herein, an extensible/contractible amount is in a range from −0.01% to +0.01%. In practice, the resin sheet 33 may be extended or contracted by ±0.01% in the state that it is extended by, e.g., 0.02%. Accordingly, the resin sheet 33 may be extended by 0.03% at maximum.

By installing the roller transfer cylinder 3*a* configured as described above, the printing method, in which the deviation amount deviated from the design dimension of printing pattern in X and Y directions is corrected to print the printing pattern, is accomplished.

In the present embodiment, a linear distortion composition (linear distortion mode) is extracted from a deformation and distortion map by the image distortion processing circuit 25, and a correction amount in the pressing amount h, a correction amount in the extensible/contractible amount along the rotational shaft RC of the roller transfer cylinder 3*a* are transmitted to the roller control circuit 26 based on the extracted linear distortion mode. The roller control circuit 26 separately adjusts the pressing amount h and the extensible/contractible amount of the roller transfer cylinder 3*a* based on the received correction amounts. Accordingly, since the pattern on the water repellent blanket 16 can be desirably contracted or extended along the X direction, and further, it can be contracted or extended along the Y direction, the printing pattern is prevented from being deviated from the design dimension of the device in both of X and Y directions.

The printing method in accordance with the present embodiment may be performed as the printing method in accordance with the first embodiment described by referring to the flowchart shown in FIG. 7, or as the printing method in accordance with the first modification of the first embodiment described by referring to the flowchart shown in FIG. 9. Hereinafter, the printing method in accordance with the present embodiment is described by using the flowchart shown in FIG. 9.

First, a dimension of a pattern, which has been printed on the work plate 11, is measured in step S21. The dimension measurement may be performed by the substrate deformation/distortion measurement unit 23 described above or by a dimension measurement device provided separately from the printing device.

Next, measurement data obtained is analyzed to extract a linear distortion mode in step S22. Then, an extensible/contractible amount in the Y direction, a position in the Z direction (corresponding to the pressing amount h), a θ angle, a Y angle and an extensible/contractible amount along the rotational shaft RC of the roller transfer cylinder 3*a* are set to control the six axis driving mechanisms 4*a* and 5*a* and the extension/contraction unit 34, based on the extracted linear distortion mode in step S23. Thereafter, the six axis driving mechanisms 4*a* and 5*a* and the extension/contraction unit 34 are adjusted to apply the set values, and the printing treatment in the printing process in the flowchart shown in FIG. 7 is performed in step S24.

A linear change in the reduction rate along the rotational shaft RC may be corrected by adjusting the extensible/contractible amount in the Y direction. Further, by adjusting the position in the Z direction, e.g., the average reduction rate may be corrected in the surface of the work plate 11. Furthermore, a linear change in the reduction rate along the moving direction of the tables 4 and 5 (X direction) may be corrected by adjusting the Y angle. Moreover, a linear change in the reduction rate along the direction (Y direction) orthogonal to the moving direction of the tables 4 and 5 may be corrected by adjusting the θ angle. After performing these corrections, the printing pattern can be printed on the work plate 11 to be superimposed.

In the flowchart shown in FIG. 9, the extensible/contractible amount in the Y direction, the position in the Z direction, the θ angle, and the Y angle are adjusted before performing the printing. However, the printing may be performed while changing the extensible/contractible amount in the Y direction, the position in the Z direction, the θ angle, and the Y angle. Accordingly, even if the extensible/contractible amount is minutely changed along the Y direction as well as the X direction, the printing pattern is prevented from being deviated from the design dimension of the device, and the printing pattern is printed with high dimensional accuracy.

Further, in the second embodiment, the printing method may be performed as those in accordance with the second and third modifications of the first embodiment. Therefore, the printing pattern is prevented from being deviated from the design dimension of the device, and the printing pattern is printed with high dimensional accuracy.

While the invention has been shown and described with respect to the embodiments, the present invention is not limited thereto. It will be understood by those skilled in the art that various changes and modifications may be made without departing from the scope of the invention as defined in the following claims.

What is claimed is:

1. A printing device which includes a transfer roller and a supporting unit for supporting a target substrate to be printed and wherein the printing device prints a printing pattern formed on the transfer roller onto the target substrate by rotating the transfer roller on the target substrate, the printing device further comprising:

an imaging unit configured to obtain an image of a surface of the target substrate which has another printing pattern printed thereon;

an image distortion processing circuit configured to extract a linear distortion component from the image and adjust a pressing amount of the target substrate against the transfer roller based on the extracted linear distortion component; and an adjusting mechanism configured to transfer, when the transfer roller is rotated on the target substrate, the printing pattern formed on the transfer roller onto the target substrate by pressing the target substrate based on the adjusted pressing amount, wherein a reduction ratio of the transferred printing pattern formed on the target substrate relative to the printing pattern formed on the transfer roller varies, along a rotating direction of the transfer roller, depending on the adjusted pressing amount.

2. The printing device described in claim 1, further comprising an extension/contraction unit for extending/contracting the printing pattern formed on the transfer roller along a rotational shaft of the transfer roller by extending/contracting the transfer roller along the rotational shaft.

3. The printing device described in claim 1, further comprising:

a mark detection unit configured to detect first position alignment marks formed on the target substrate and second position alignment marks formed on the transfer roller before the first position alignment marks make contact with the second position alignment marks; and a table driving circuit configured to align a relative position between the target substrate and the transfer roller based on a deviation amount between the first and the second position alignment marks, wherein the first and the second position alignment marks are detected simultaneously while the target substrate moves and the transfer roller rotates simultaneously, and wherein the relative position between the target substrate and the transfer roller is aligned such that the second position alignment marks are superimposed on the first position alignment marks when the first position alignment marks make contact with the second position alignment marks.

4. The printing device described in claim 3, wherein the mark detection unit includes:

a half mirror which is configured to divide a light emitted from a light source into two lights by transmitting and reflecting the light from the light source, the two lights being directed to the transfer roller and the target substrate, respectively, and mix the light reflected from the transfer roller and light reflected from the target substrate; and an imaging device for imaging the transfer roller and the target substrate by receiving the mixed light from the half mirror.

5. The printing device described in claim 1, wherein the adjusting mechanism is further configured to adjust a slope of the target substrate when transferring the printing pattern formed on the transfer roller onto the target substrate.

6. The printing device described in claim 1, wherein the reduction ratio becomes smaller as the pressing amount becomes smaller.

7. The printing device described in claim 1, wherein a rotational speed of the transfer roller and a moving speed of the target substrate are equal to each other.

8. A printing method for printing a printing pattern formed on a transfer roller onto a target substrate to be printed, which is supported by a supporting unit, by rotating the transfer roller on the target substrate, the method comprising:

obtaining an image of a surface of the target substrate which has another printing pattern printed thereon;

extracting a linear distortion component from the image and adjusting a pressing amount of the target substrate against the transfer roller based on the extracted linear distortion component; and transferring the printing pattern formed on the transfer roller onto the target substrate by pressing the target substrate based on the adjusted pressing amount, wherein a reduction ratio of the transferred printing pattern formed on the target substrate relative to the printing pattern formed on the transfer roller varies, along a rotating direction of the transfer roller, depending on the adjusted pressing amount.

9. The printing method described in claim 8, further comprising:

extending/contracting the printing pattern formed on the transfer roller along a rotational shaft of the transfer roller by an extension/contraction unit.

10. The printing method described in claim 8, further comprising:

detecting first position alignment marks formed on the target substrate and second position alignment marks formed on the transfer roller before the first position alignment marks make contact with the second position alignment marks; and aligning a relative position between the target substrate and the transfer roller based on a deviation amount between the first and the second position alignment marks, wherein the first and the second position alignment marks are detected simultaneously while the target substrate moves and the transfer roller rotates simultaneously, and wherein the relative position between the target substrate and the transfer roller is aligned such that the second position alignment marks are superimposed on the first position alignment marks when the first position alignment marks make contact with the second position alignment marks.

11. The printing method described in claim 10, wherein said detecting the first and the second position alignment marks includes:

emitting a light from a light source;

dividing the emitted light by a half mirror into two lights by transmitting and reflecting the emitted light, the two lights being directed to the transfer roller and the target substrate, respectively, and mixing the light reflected from the transfer roller and light reflected from the target substrate by the half mirror; and imaging the transfer roller and the target substrate by receiving the mixed light from the half mirror by an imaging device.

12. The printing method described in claim 8, wherein a slope of the target substrate is adjusted when transferring the printing pattern formed on the transfer roller onto the target substrate.

13. The printing method described in claim 8, wherein the reduction ratio becomes smaller as the pressing amount becomes smaller.

14. The printing method described in claim 8, wherein a rotational speed of the transfer roller and a moving speed of the target substrate are equal to each other.

15. The printing method described in claim 8, further comprising:

controlling, prior to said obtaining the image of the surface of the target substrate, geometric accuracy of the supporting unit mounting thereon the target substrate and another supporting unit mounting thereon a master substrate which is employed in forming the printing pattern on the transfer roller.

16. A non-transitory computer-readable storage medium storing therein a program to execute the printing method described in claim 8.

* * * * *